US005159784A

United States Patent [19]

Varner, Sr. et al.

[11] Patent Number: 5,159,784

[45] Date of Patent: Nov. 3, 1992

[54] PORTABLE APPARATUS FOR SHARPENING BLADES

[76] Inventors: James E. Varner, Sr., 5125 Rivermont Dr., Jackson, Miss. 39212; June W. DePriest, 217 Longwood Dr., Clinton, Miss. 39056

[21] Appl. No.: 743,834

[22] Filed: Aug. 12, 1991

[51] Int. Cl.[5] ..... B24B 3/36

[52] U.S. Cl. ..... 51/173; 51/246; 51/210

[58] Field of Search ..... 51/173, 246, 209 R, 51/210, 222; 76/82.1, 88

[56] References Cited

U.S. PATENT DOCUMENTS

| | | | |
|---|---|---|---|
| 1,961,328 | 6/1934 | Beach | 51/173 |
| 2,897,640 | 8/1959 | Hermann et al. . | |
| 2,921,416 | 1/1960 | Shanahan . | |
| 2,993,312 | 7/1961 | Holland et al. . | |
| 3,019,568 | 2/1962 | Sauers et al. . | |
| 3,122,865 | 3/1964 | Kolling . | |
| 3,139,710 | 7/1964 | Ralston . | |
| 3,800,480 | 4/1974 | Keating . | |

*Primary Examiner*—Roscoe V. Parker
*Attorney, Agent, or Firm*—Frost & Jacobs

[57] ABSTRACT

A portable blade sharpening apparatus is disclosed which can be used to sharpen blades while they remain attached to their machines. The blade sharpening apparatus is powered by an electric motor and includes a circular grinding stone which is angled on one side in order to match the angle of the blade to be sharpened. The angle of the grinding stone can be varied, depending upon the angle of the blade that is to be sharpened. The blade sharpening apparatus includes a guide bracket having fingers positioned to limit movement of the grinding stone relative to the blade being sharpened so as to prevent accidental contact between the blade and the drive shaft of the grinding stone.

6 Claims, 1 Drawing Sheet

PORTABLE APPARATUS FOR SHARPENING BLADES

TECHNICAL FIELD

The present invention relates generally to blade sharpening tools and is particularly directed to electrically-operated blade sharpening instruments which are portable. The invention will be specifically disclosed in connection with a portable blade sharpening instrument which uses an electric motor and can be used to sharpen blades on devices while the blades remain attached to the devices.

BACKGROUND OF THE INVENTION

Portable blade sharpening tools have been used for many years. An example of such tools in the prior art is Hermann, U.S. Pat. No. 2,897,640, which discloses a blade sharpener used for sharpening a blade's elongated, beveled cutting edge. The Hermann blade sharpener uses two handles to press the grinding stone against the cutting edge of the blade, one handle attached to a backing plate which is pressed against the back (non-sharp) edge of the blade, and a second handle attached to a small frame that has the grinding stone mounted to it. The grinding stone is pressed against the beveled cutting edge of the blade as it is sharpened. The Hermann apparatus necessarily requires two hands in order to operate its function. A second example of such tools in the prior art is Holland, U.S. Pat. No. 2,993,312, which discloses a blade sharpener which is attached to an electric drill. In Holland, a cylindrical sharpening stone is rotated against the cutting edge of a blade, and can be used in some cases while the blade is still attached to its machine. A tapered guide is provided which assists in holding the sharpening stone against the beveled cutting edge of the blade at the correct angle. The tapered guide rotates along with the sharpening stone in order to reduce friction at the apparatus is moved along the edge of the blade.

Other portable blade sharpening tools in the prior art have been specifically designed to sharpen blades of lawn mowers, both reel-type and rotary-type mowers. Most of such tools have been designed so as to be used while the blades are still attached to their respective mowers. One example of a rotary mower blade sharpening tool is Kolling, U.S. Pat. No. 3,122,865, which discloses a rotary grinding stone and guide that is attached to an electric drill. Both the grinding stone and guide rotate, and both are beveled so as to hold the blade being sharpened at the correct angle. The two beveled surfaces (of the stone and the guide) define an acute angle (60 degrees in the preferred embodiment) which renews the sharp edges of a blade with little or no tendency to form burrs on the blade. The user of the apparatus simply presses it down firmly against the cutting edge of the blade in order to sharpen it.

Another example of a rotary mower blade sharpening tool is Ralston, U.S. Pat. No. 3,139,710, which uses an electric motor or drill to rotate a grinding wheel which sharpens the blade. The apparatus includes a frame that is pressed against the back side of the blade to position the blade at the correct angle to the grinding wheel. The frame has a circular guide that the rear edge (the non-sharp edge) of the blade is pulled up against. The Ralston grinding wheel is not tapered, but rather is completely cylindrical. The side wall of the cylindrical grinding wheel is pressed against the cutting edge of the blade as the blade is being sharpened. The position of the circular guide in the frame can be adjusted to adjust for blades of varying width.

Another example of a rotary mower blade sharpening tool is Keating, U.S. Pat. No. 3,800,480, which has a guide plate along the side of the motor housing that is pressed against the back surface of the blade. The motor output shaft is coupled to a pinion, which is, in turn, coupled to a spur gear. The spur gear is coupled to a grinding wheel, which is pressed against the leading edge of the blade (the cutting edge) at an acute angle. The angle of the grinding wheel against the blade cutting edge is determined by the angle of the coupling between the pinion and the spur gear. This system is relatively intricate from a mechanical standpoint, since the angle of cutting cannot be changed easily.

Some of the devices of the prior art are somewhat unwieldy in that a relatively large portion of the device must be placed over the opposite side of the blade to be sharpened, and there is only limited space available in the interior regions of the lawn mower that is having its blade sharpened. Holland, U.S. Pat. No. 2,993,312, discloses a cylindrical grinding wheel having its entire bulk within the interior region of the mower. Keating, U.S. Pat. No. 3,800,480, discloses a spur gear with grinding wheel attached that must fit into the interior region of the mower. Ralston, U.S. Pat. No. 3,139,710, discloses a frame with a circular guide that must fit into the interior region of the mower. Ralston's FIG. 1 depicts enough clearance to enable the apparatus to fit within the required space, but it is obvious that the smaller the size of the portion of the apparatus that fits into the interior region of the mower, the more likely that the apparatus will be easily usable.

SUMMARY OF THE INVENTION

Accordingly, it is a primary object of the present invention to provide a portable, electrically-operable blade sharpener which includes a relatively small portion of the apparatus that must fit into the interior region of a mower or other machine, and which includes a guide bracket that limits the movement of the blade, as it is being sharpened, toward the grinding stone shaft.

It is another object of the present invention to provide a portable blade sharpener which can operate with various grinding stones each having different grinding angles. In this way, a great variety of blades can be sharpened by use of a single portable blade sharpener.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved portable blade sharpening instrument is provided for sharpening blades while the blades remain attached to their machine. The blade sharpening instrument is powered by an electric motor which has its output shaft connected to a chuck. The chuck can receive the shaft portion of a circular grinding stone. The grinding stone includes an angled portion which faces toward the motor, having an angle which is suitable for sharpening a blade.

In accordance with a further aspect of the invention, the overall blade sharpening instrument has a small enough size, and a configuration which allows it to sharpen a blade while the blade is still attached to its machine.

In accordance with another aspect of the invention, the blade sharpening instrument includes a guide bracket which is attached to the motor casing at its output shaft end, and which limits the movement of the blade being sharpened so that the blade cannot come into contact with the shaft portion of the grinding stone. The guide bracket also aligns the blade with the grinding stone so that there is proper orientation of the blade against the grinding stone for effective sharpening.

According to yet another aspect of the invention, the blade sharpening instrument includes a grinding stone which has an adjustable shaft portion so that the grinding stone, while in the chuck, can be adjusted to the proper distance from the bracket. The shaft portion is long enough so that it can sharpen blades of various thicknesses. These features of the grinding stone also allow it to compensate for wear of the grinding stone after normal use.

Still other objects of the present invention will become apparent to those skilled in this art from the following description wherein there is shown and described a preferred embodiment of this invention. As will be realized, the invention is capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE PREFERRED EMBODIMENT

Figure 1:
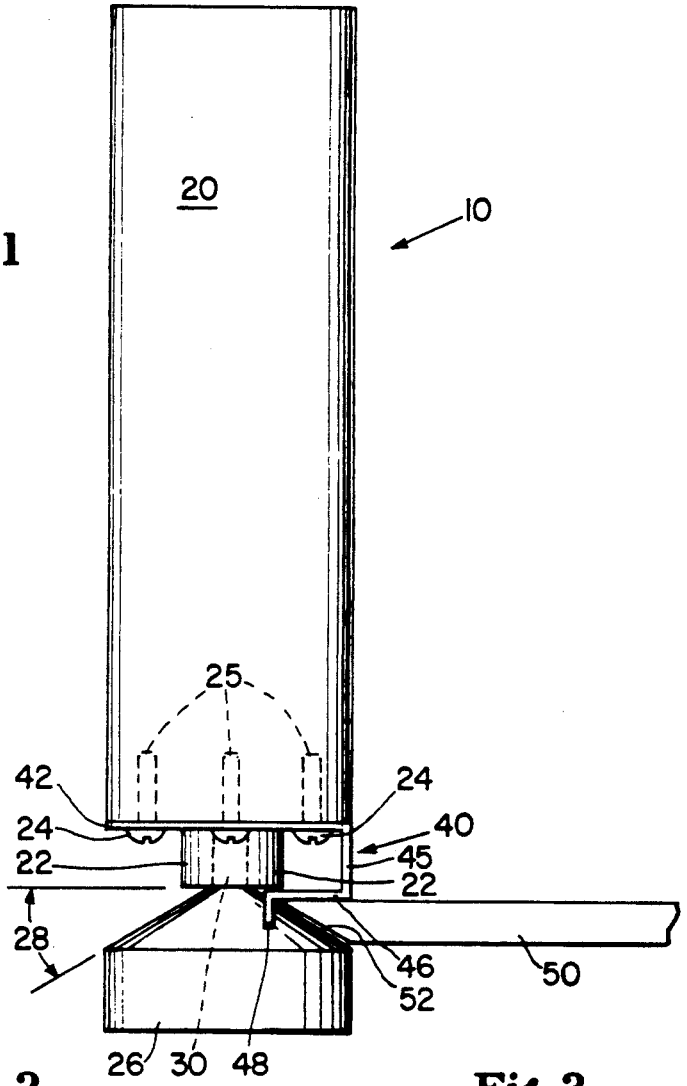
FIG. 1 is a side elevational view of a portable electric blade sharpener built in accordance with the present invention.
Figure 2:
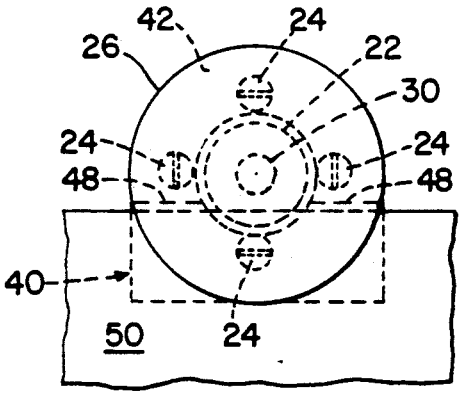
FIG. 2 is a front elevational view of the portable electric blade sharpener depicted in FIG. 1.

Referring now to the drawings, FIG. 1 shows a side view of a portable electric blade sharpener generally designated by the numeral 10, constructed in accordance with the present invention. Blade sharpener 10 includes an electric motor 20 which is, preferably, powered by 110 volts AC, single phase. Electric motor 20 has an output shaft which is not viewable in FIG. 1, but is coupled to a one-quarter inch chuck 22. Once the chuck 22 is coupled to the output shaft of electric motor 20, the chuck 22 will rotate in conjunction with the rotor of the motor 20.

A generally circular grinding stone 26, having a shaft portion 30, is mounted to the motor via the chuck 22. The shaft portion 30 of the grinding stone 26 is inserted into the chuck 22, for ease of attachment and detachment. On the side of the grinding stone 26 which faces the motor, grinding stone 26 is angled. The angle 28 of the grinding stone can be varied, depending upon the angle of the blade that is to be sharpened. By use of the chuck 22, it is easily seen that a particular grinding stone 26 can be easily detached from the blade sharpener 10, and a second grinding stone 26 having a different angle 28 can then be attached in its place.

Figure 3:
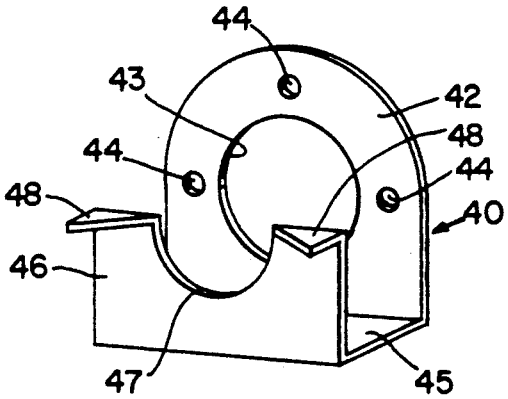
FIG. 3 is a perspective view of a guide bracket used in the portable electric blade sharpener of FIGS. 1 and 2.

A guide bracket 40 is attached to the end of the motor 20 at its output end. As best seen in FIG. 3, the guide bracket 40 has a base plate 42 having an annular opening 43 of a size to freely surround the chuck 22 when the base plate 42 is seated against the output end of the motor 20. The base plate 42 is attached to the motor casing by screws 24, preferably four in number, in which event four screw holes 44 are provided in base plate 42 through which the screws 24 are inserted for attachment to the motor 20, the screws being received in threaded holes 25 in the motor housing, as best seen in FIG. 1.

Referring again to FIG. 3, the base plate 42 of guide bracket 40 is provided at its lowermost end with an angularly disposed flange 45 which mounts an upwardly projecting extension 46 having a centrally disposed U-shaped opening 47 lying in alignment with the lower half of the annular opening 43 in base plate 42. The extension 46 terminates at its upper end in a pair of outwardly projecting fingers 48 lying on opposite sides of the U-shaped opening 47. In the illustrated embodiment, the fingers 48 are beveled toward the centerline of guide bracket 40, in order to allow grinding stone 26 to be placed such that its shaft portion 30 penetrates deeply within the chuck 22, yet while keeping the overall size of guide bracket 40 to a minimum.

The orientation of the blade 50 with respect to the grinding stone 26, as the blade is being sharpened, is depicted in FIG. 1 wherein it will be seen that as the beveled portion of grinding stone 26 is displaced laterally toward the cutting edge 52 of the blade 50, the fingers 48 serve as stops to limit lateral movement of the grinding stone 26 in the direction of the cutting edge 52. With this arrangement, the fingers 48 prevent inadvertent contact between the edge of the blade 50 and the shaft portion 30 of the grinding stone, which could damage both the blade and the shaft.

As will be evident, the configuration of the guide bracket is such that the chuck 22 will lie between the base plate 42 and the extension 46, with the outwardly projecting fingers 48 spaced apart by a distance sufficient to accommodate the beveled surface of the grinding stone 26 therebetween. In use, the extension 46 of the guide bracket is simply seated against the outer surface of blade 50 adjacent the cutting edge 52 and serves as a guide when the grinding stone 26 is moved laterally for contact with the cutting edge of the blade. The fingers 48 serve to automatically stop continued lateral movement of the grinding stone 26 before the edge of the blade 52 can make contact with the shaft 30.

The shaft portion 30 of grinding stone 26 is long enough so that grinding stone 26 can be adjusted at different distances from guide bracket 40. Such adjustment can be easily carried out by the proper positioning of grinding stone 26 within the chuck 22. In this way, various thicknesses of the blade 50 to be sharpened can be accommodated, and compensation can be made for the normal wear of the grinding stone 26. To this end, the fingers 48 will be of a length sufficient to stop lateral movement of the grinding stone irrespective of its position relative to the chuck.

In summary, numerous benefits have been described which result from employing the concepts of the invention. The blade sharpener provides a reliable instrument for sharpening blades while such blades are still attached to their machines, and allows for one-hand operation. The blade sharpener is powered by an electric motor which has a quarter-inch chuck attached to it for ease of attachment and detachment of various angled grinding stones. The blade sharpener can accommodate various grinding stones each of which have a different grinding angle, and can accommodate various thicknesses of blades, by positioning the grinding stone properly within the chuck. The blade sharpener includes a guide bracket which limits the movement relative to the blade being sharpened so that the blade cannot come into contact with the shaft portion of the grinding stone. The guide bracket also aligns the blade against the grinding stone so that effective sharpening can take place.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A portable blade sharpener comprising:

(a) a rotating electric motor having an output shaft at one end thereof;

(b) a chuck operatively connected to said output shaft;

(c) a circular grinding stone having a drive shaft operatively connected to said chuck, said grinding stone having an angled portion facing said motor, said angled portion of said grinding stone tapering inwardly toward said drive shaft; and (d) a stationary guide bracket fixedly secured to said motor adjacent said grinding stone, said guide bracket having a spaced apart pair of guide fingers lying on opposite sides of said grinding stone, said guide fingers being positioned to seat against the edge of a blade being sharpened so as to position the blade for contact with the angled portion of said grinding stone while preventing contact of the blade with said drive shaft.

2. The portable blade sharpener claimed in claim 1 wherein said stationary guide bracket has a base plate juxtaposed to the end of said motor, and fastener means detachably securing said base plate to said motor.

3. The portable blade sharpener claimed in claim 2 wherein said stationary guide bracket includes a flange projecting outwardly from said base plate, an extension at the outer end of said flange projecting toward said grinding stone, said fingers being mounted on said extension and projecting outwardly therefrom, said extension being positioned to contact the face of a blade being sharpened, whereby the stationary guide bracket aligns the blade being sharpened into the proper orientation against said grinding stone.

4. The portable blade sharpener claimed in claim 3 wherein the base plate of said guide bracket has an opening therein of a size to freely surround said chuck.

5. The portable blade sharpener claimed in claim 4 wherein said flange is of a width sufficient to space said extension outwardly beyond the free end of said chuck, and wherein said extension has an opening therein of a size to accommodate at least a part of the angled portion of said grinding stone.

6. An apparatus for sharpening blades as recited in claim 3, wherein said drive shaft is of a length sufficient to allow the grinding stone to be adjusted to the proper distance relative to the small extension of said stationary guide bracket, thus allowing for various thicknesses of blades being sharpened, and compensating for wear of the grinding stone.

* * * * *